US006764432B2

(12) United States Patent
Hippensteel

(10) Patent No.: US 6,764,432 B2
(45) Date of Patent: Jul. 20, 2004

(54) ANTIGRAVITY FULL RANGE OF MOTION FOUR LIMB DRY SWIM EXERCISE MACHINE

(76) Inventor: Joseph B. Hippensteel, 1109 S. Plaza Way, #314, Flagstaff, AZ (US) 86001

( * ) Notice: Subject to any disclaimer, the term of this patent is extended or adjusted under 35 U.S.C. 154(b) by 0 days.

(21) Appl. No.: 10/091,475

(22) Filed: Mar. 5, 2002

(65) Prior Publication Data

US 2003/0092533 A1 May 15, 2003

Related U.S. Application Data

(60) Provisional application No. 60/350,242, filed on Nov. 10, 2001.

(51) Int. Cl.[7] ..... A63B 69/10

(52) U.S. Cl. ..... 482/56; 482/62; 482/142

(58) Field of Search ..... 482/55, 56, 62, 482/142, 51, 60, 138

(56) References Cited

U.S. PATENT DOCUMENTS

| | | | | | |
|---|---|---|---|---|---|
| 326,247 | A | * | 9/1885 | Root | 482/56 |
| 1,176,365 | A | * | 3/1916 | Hartnett | 482/56 |
| 1,966,448 | A | * | 7/1934 | Kabisius | 482/56 |
| 2,019,224 | A | * | 10/1935 | Hess | 482/56 |
| 2,332,184 | A | * | 10/1943 | Sweeney | 601/26 |
| 3,074,716 | A | * | 1/1963 | Mitchel et al. | 482/56 |
| 3,731,921 | A | * | 5/1973 | Andrews, Jr. | 482/56 |
| 3,976,058 | A | * | 8/1976 | Tidwell | 601/24 |
| 4,162,788 | A | * | 7/1979 | Turnier | 482/56 |
| 4,422,634 | A | * | 12/1983 | Hopkins | 482/8 |
| 4,674,740 | A | * | 6/1987 | Iams et al. | 482/56 |
| 4,830,363 | A | * | 5/1989 | Kennedy | 482/56 |
| 4,840,428 | A | * | 6/1989 | Kobayashi et al. | 297/408 |
| 5,282,748 | A | * | 2/1994 | Little | 434/254 |
| 5,376,060 | A | * | 12/1994 | Murray | 482/56 |
| 5,393,280 | A | * | 2/1995 | Haviv | 482/56 |

* cited by examiner

*Primary Examiner*—Nicholas D. Lucchesi
*Assistant Examiner*—Tam Nguyen
(74) *Attorney, Agent, or Firm*—Alston & Bird LLP

(57) ABSTRACT

An antigravity full range of motion four limb dry swim overall body exercise machine that allows virtually every muscle in the body to work anaerobically or aerobically, at the user's choosing, while the user is lying down on their back to take pressure off the user's spine, and working most muscles through a nominal or up to a full range of motion at the user's choosing, which motions can be in one of several directions or arcs at the user's choosing. The machine includes a base frame with parallel frame adjustable lengths and supporting cross segments horizontally and vertically to a second parallel frame length above the first, the entire base frame having a first end and a second end, the first end having frame adjustments to accept length and tension adjustable arm apparatuses with handles, the second end having frame adjustments to accept length and tension adjustable leg apparatuses with pedals. Mounted on top of the base frame top parallel lengths are padded bench apparatuses, one for the torso which can include a headrest and one for the hips. The middle of the length of the base frame has a spring or shock absorber type structure to allow the middle top level of the base frame, supporting the seat and torso apparatuses, to have an up and down motion to allow for abdominal flexion of the user permitted by a pivoting action of the seat and torso apparatus sections of the upper level of the base frame. The seat and torso apparatus sections are permitted to pivot in a seesaw type action by a fulcrum cross piece under and supporting the center of each bench section.

19 Claims, 3 Drawing Sheets

ANTIGRAVITY FULL RANGE OF MOTION FOUR LIMB DRY SWIM EXERCISE MACHINE

CROSS REFERENCE TO RELATED APPLICATION

This application claims priority under 35 U.S.C. 119 to the benefit of the filing date of Hippensteel U.S. patent application Ser. No. 60/350,242, which was filed on Nov. 10, 2001, entitled "ANTIGRAVITY FULL RANGE OF MOTION FOUR LIMB DRY SWIM EXERCISE MACHINE," which is incorporated herein by reference.

BACKGROUND OF THE INVENTION

1. Field of the Invention

The present invention relates generally to exercise machines and more specifically relates to an antigravity full range of motion four limb dry swim exercise machine for providing an overall body exercise machine that allows virtually every muscle in the body to work anaerobically or aerobically, at the user's choosing, while the user is lying down on their back to take pressure off the user's spine, and working most muscles through a minimal or up to a full range of motion at the user's choosing, which motions can be in one of several directions or arcs at the user's choosing.

2. Description of the Prior Art

Exercise machines of various types have been in use for many years directed to accomplishing many types of fitness results. Typically, exercise machines include many types of exercise devices that perform either a single exercise or multiple exercises using different muscle groups and movements. The devices generally utilize weights, springs, resistance devices or pulleys and sometimes enable the user to create motion against the gravity affect on the user's body weight.

One main problem with conventional exercise machines is that most machines or devices or free weights, like barbells and dumbbells, only allow for a limited range of motion and limited muscle groups working at one time. Another problem with conventional exercise machines is that they provide either aerobic or anaerobic exercises, but usually not both, and the machines usually focus on one motion repetitively. A further problem with conventional exercise machine is that there is no capability of providing a right and left coordinating, balancing type action while making use of many muscle groups and performing the exercise without the compressing effect of gravity on the spine.

While these devices may be suitable for the particular purpose to which they address, they are not as suitable for providing an overall body exercise machine that allows virtually every muscle in the body to work anaerobically or aerobically, at the user's choosing, while lying down on the user's back to take pressure off the user's spine, and working most muscles through a minimal or up to a full range of motion at the user's choosing, which motions can be in one of several directions or arcs at the user's choosing.

SUMMARY OF THE INVENTION

The present invention provides a new antigravity full range of motion four limb dry swim exercise machine construction which can be utilized for providing an overall body exercise machine that allows virtually every muscle in the body to work anaerobically or aerobically, at the user's choosing, while lying down on one's back to take pressure off the user's spine, and working most muscles through a minimal or up to a full range of motion at the user's choosing, which motions can be in one of several directions or arcs at the user's choosing.

The construction generally includes a base frame with parallel frame members and supporting cross segments horizontally and vertically to a second or top parallel frame member mounted above the first frame member. The base frame includes a first end and a second end, with the first end having frame adjustment elements to accept arm apparatuses and the second end having frame adjustment elements to accept leg apparatuses. Mounted on top of the base frame top parallel members are padded bench apparatuses, one for the torso and one for the hips. Adjustably fitted to the first end of the base frame are arm apparatuses for each arm, and at the second end of the base frame is an adjustably fitted leg apparatus. Each of the two arm apparatuses and one leg apparatus have a first end and a second end, the first ends having an adjustable fitting for width for arms and length for arms and legs and a second end having a handle for arms and a pedal for the feet with a tension device in communication with the middle of the length of each of the arm and leg apparatuses. The base frame forms an elongate two-tiered structure with an adjustable fitting section of the frame for adjusting the frame length approximately near the first end. The middle of the length of the base frame has a spring or shock absorber type structure to allow the middle top level of the base frame, supporting the seat and torso apparatuses, to have an up and down motion to allow for abdominal flexion of the user permitted by a pivoting action of the seat and torso apparatus sections of the upper level of the base frame. The seat and torso apparatus sections are permitted to pivot in a seesaw type action by a fulcrum cross piece under and supporting the center of each bench section.

The bench apparatus is an elongate covered padded structure commonly found in the market place, preferably in two sections, a torso supporting section and a hip supporting section. Attached to the first end of the torso section is a similarly padded headrest section. The arm apparatuses are an elongate structure having a first end, a middle section and a second end. The first end has a rotatable handle perpendicular to an adjustable length arm adjoining a middle section having a tension creating or releasing device, and a second end adaptably fitted to the base frame first end adjustable vertical arm accepting section. The leg apparatus is an elongate structure having a first end, a middle section, and a second end with two opposable rotating arm pedal parts. The first end adaptably and adjustably fits into the leg accepting section of the base frame second end. The length of the first end of the leg apparatus is adjustable along its length to the middle section. The middle section of the leg apparatus is adaptably and rotatingly adjoined to a tension creating and releasing device. The second ends of the leg apparatus are opposing arm type structures, each rotating outwardly and circularly around the axis of the tension device, and having a pedal structure on each end perpendicular to the adjustable arm length extending from the tension device.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways and is only limited to the claims attached hereto. Also, it is to be understood that the phraseology and terminology employed herein are for the purpose of the description and should not be regarded as limiting the scope of the present invention.

A primary object of the present invention is to provide an antigravity full range of motion four limb dry swim exercise machine that will overcome the shortcomings of the prior art devices.

An object of the present invention is to provide an antigravity full range of motion four limb dry swim exercise machine for providing an overall body exercise machine that allows virtually every muscle in the body to work anaerobically or aerobically, at the user's choosing, while lying down on one's back to take pressure off the user's spine, and working most muscles through a minimal or up to a full range of motion at the user's choosing, which motions can be in one of several directions or arcs at the user's choosing.

Another object is to provide an antigravity full range of motion four limb dry swim exercise machine that allows for a minimal or all the way up to a fully extended range of motion of the user's limbs.

Another object is to provide an antigravity full range of motion four limb dry swim exercise machine that allows the simultaneous use of almost every muscle group in the user's body.

Another object is to provide an antigravity full range of motion four limb dry swim exercise machine that allows the user to perform a full body workout without the detrimental compressing effects of gravity on the spine while exercising.

Another object is to provide an antigravity full range of motion four limb dry swim exercise machine that allows for a balanced right and left full body action that helps reinforce coordination and body control for the user.

Another object is to provide an antigravity full range of motion four limb dry swim exercise machine that allows the user to exercise aerobically or anaerobically with simple resistance creating or releasing devices so that many goals can be accomplished like toning, slimming, building muscle mass, or cardiovascular efficiency.

Another object is to provide an antigravity full range of motion four limb dry swim exercise machine that is light, inexpensive, portable, easily stored, small and compact.

Another object is to provide an antigravity full range of motion four limb dry swim exercise machine that is fin for a user to use, because of it's versatility in ranges of motion, directions of motion, amount of resistance, and the ability to use more muscles than other exercise machines or devices, therefore allowing a full body workout in much less time.

Other objects and advantages of the present invention will become clear to one skilled in the art and it is intended that these objects and advantages are within the scope of the present invention.

To accomplish the above and related objects, this invention may be embodied in the form illustrated in the accompanying drawings, attention being called to the fact, however, that the drawings are illustrative only, and that changes may be made in the specific construction illustrated without departing from the scope of the present invention.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
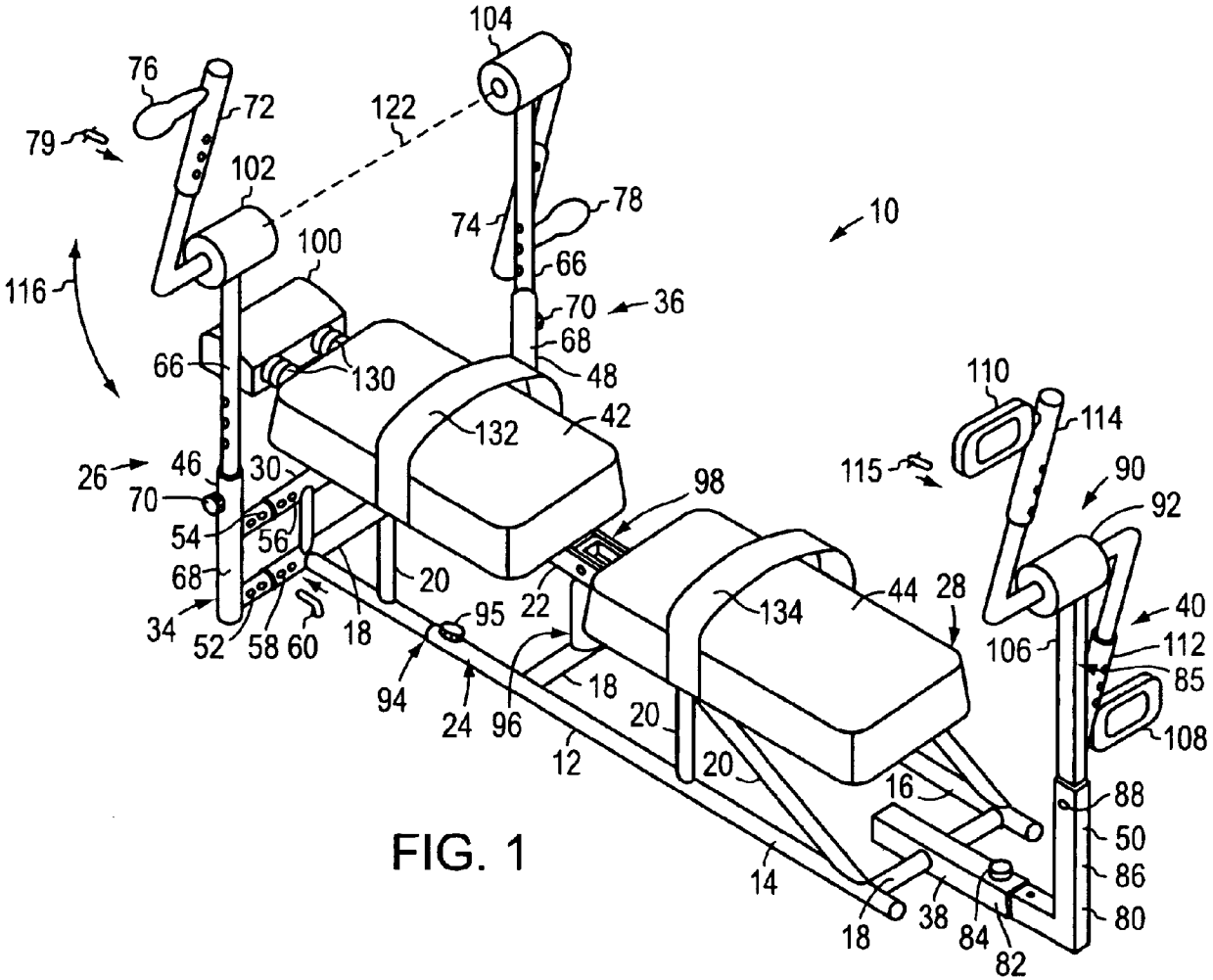
FIG. 1 illustrates a perspective view of the present invention.

Referring now descriptively to the drawings, in which the same reference characters denote the same or similar elements throughout the Figures, an antigravity full range of motion four limb dry swim exercise machine or system embodiment of the present invention is designated by the reference numeral 10. The system 10 includes a base frame 12 having a pair of parallel frame members 14, 16. The base frame 12 includes a plurality of supporting horizontal cross segments or members 18 and a plurality of vertical segments or members 20 to support a second parallel top frame 22 above the base frame 12 and forming a frame unit 24 for the system 10. The frame unit 24 including a first end 26 and a second end 28 with the first end 26 having a pair of frame adjustment members 30, 32, which adjustably accept respective arm apparatuses 34, 36. The second end 28 having a frame adjustment member 38 to adjustably accept a leg apparatus 40.

Mounted on top of the frame unit 24, on the top frame 22 are a pair of padded bench pads or supports 42, 44, one for the torso 42 and one for the hips 44. Adjustably fitted to the first end 26 of the frame unit 24 are the arm apparatuses 34, 36, one for each arm of the user (not illustrated) and at the second end 28 of the frame unit 24 is the adjustably fitted leg apparatus 40. Each of the two arm apparatuses 34, 36 and the leg apparatus 40 has a first end 46, 48 and 50 for adjustably fitting into the frame unit 24. The first ends 46, 48 of the arm apparatuses 34, 36 having an adjustable fitting formed by a pair of tubes 52, 54 (the tubes 52, 54 only illustrated in FIG. 1 for the apparatus 34) adjustably and slidably engaged within a pair of larger tubes 56, 58 formed in or with the frame unit 24. The tubes 52, 54 are laterally adjustable for the width of the shoulders and arms of a user and locked by a pin 60 which can be inserted through mating holes in the respective tubes 52, 54 and 56, 58. The length of the arms of the user can be accommodated in a similar fashion by a vertical tube 66 slidably engaged in a tube 68 and locked by a pin or bolt 70. The arms 34, 36 include adjustable second ends 72, 74, each having a handle 76, 78 to be gripped by the user and locked by a pin 79.

The first leg end 50 has a rectangular L-shaped member 80 slidably engaged into a mating member 82 on the frame member 24 and locked by a pin or bolt 84 to adjust for the length of the user's legs. A second leg end 85 can be slidably mounted vertically in a second end 86 of the member 80, locked by a pin or bolt 88. A pedal device 90 for the feet includes a tension device 92 mounted on the leg end 85. The frame unit 24 has an adjustable fitting section 94 of the base frame members 14, 16 for adjusting the frame length locked by bolts or pins 95. The middle of the length of the top frame 22 has a spring or shock absorber type structure 96 to allow the middle of the frame 22, supporting the seat and torso apparatuses 42, 44, to have an up and down motion to allow for abdominal flexion of the user permitted by a pivoting action of the seat and torso apparatus sections or pads 42, 44. The seat and torso apparatus sections 42, 44 are permitted to pivot in a seesaw type action by a fulcrum cross piece 98 located under and supporting the center of each bench section 42, 44 and connected to the shock absorber 96.

The bench apparatus is an elongate covered padded structure commonly found in the market place, preferably in two sections 42, 44, the torso supporting section 42 and the hip supporting section 44. Attached to the first end of the torso section 42 is a similarly padded headrest section 100. The arm apparatuses 34, 36 each are an elongate structure having the first end 46, 48, a middle section and the second end 72, 74. The second end 72, 74 has the rotatable handle 76, 78 perpendicular to an adjustable length arm adjoining a middle section having a tension creating or releasing device 102, 104, and the second end 72, 74 adjustably fitted to the base frame first end adjustable vertical arm accepting section 32, 34. The leg apparatus 40 is an elongate structure having the first end 50, a middle section, and a second end 106 with two opposable rotating arm pedal parts 108, 110. The first end 50 adjustably fits into the leg accepting section 80 of the base frame second end 28. The length of the first end 50 of the leg apparatus is adjustable along its length to the middle section. The middle section of the leg apparatus is adaptably and rotatingly adjoining the tension creating and releasing device 92. The second ends of the leg apparatus are adjustable opposing arm type structures 112, 114, each rotating outwardly and circularly around the axis of the tension device 92 locked by pins 115, and having the pedal structure 108, 110 on each end perpendicular and adjustable on the arm length extending from the tension device 92.

Figure 2:
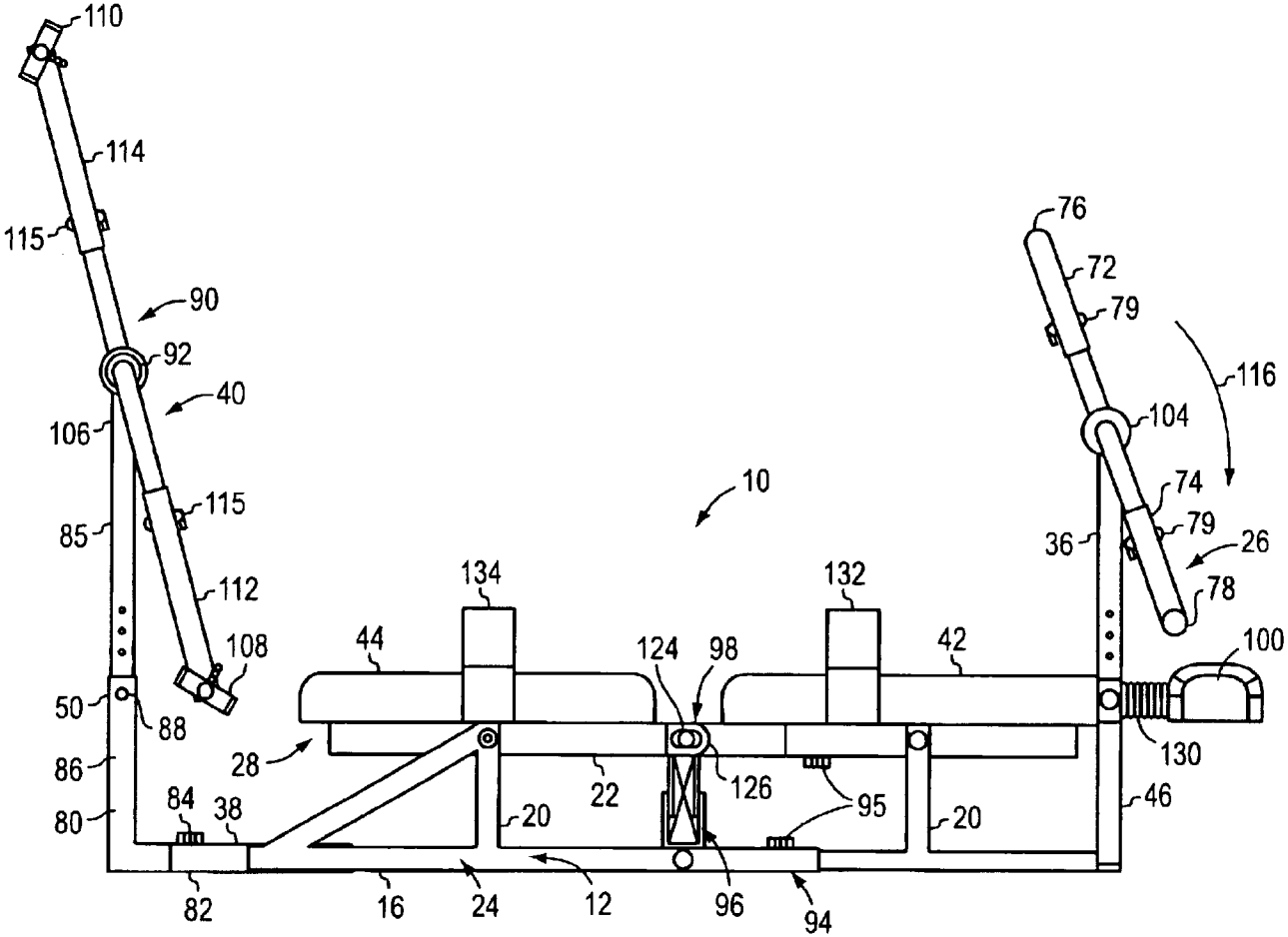
FIG. 2 illustrates a side view of the present invention.
Figure 3:
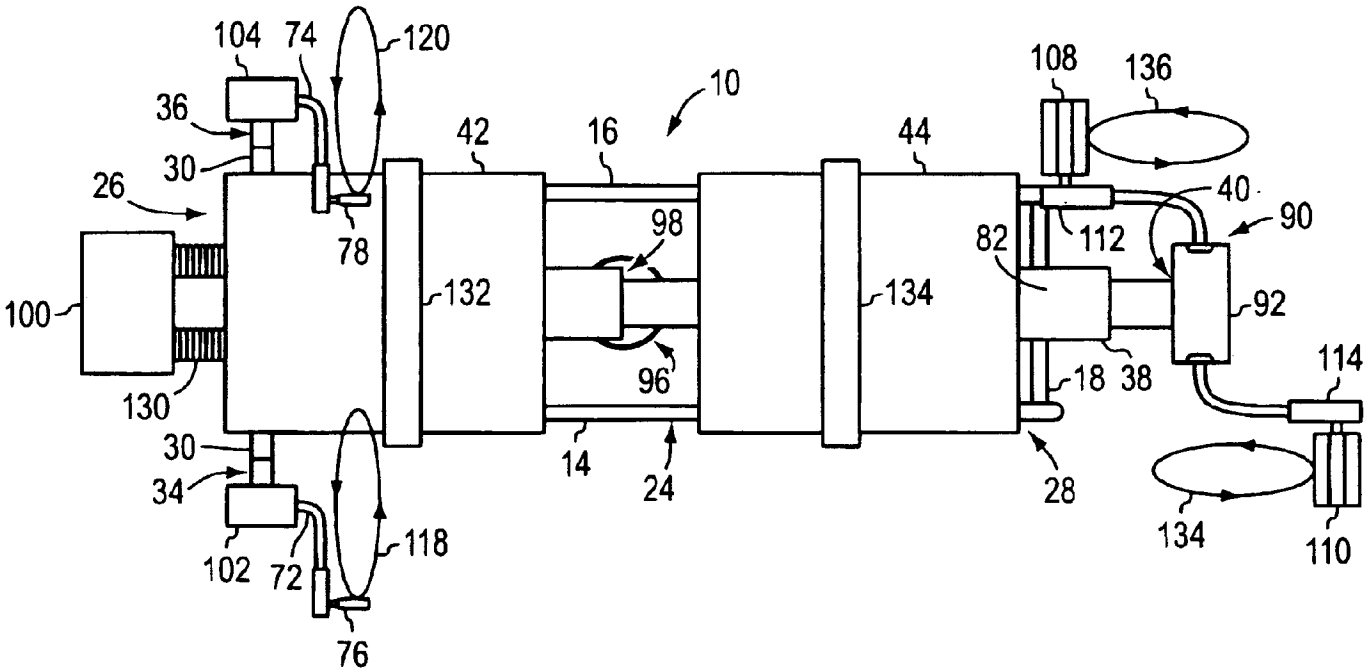
FIG. 3 illustrates a top view of the inward and outward circular action of the arm apparatus of the present invention.

As shown in FIGS. 1 and 2, the base frame unit 24 is an elongate two tiered structure with parallel frame members 12, 22 and horizontal and vertical cross supporting segments 18, 20 from the bottom level section 12 to the parallel top level section 22. The entire frame unit 24 has the first end 26 and the second end 28, the first end 26 having the shoulder width frame adjustment sections 30, 32, best shown in FIGS. 1 and 3, to accept the arm apparatuses 34, 36, and the second end 28 having leg frame longitudinal adjuster section 82 to accept the leg apparatus 40 as shown in FIGS. 1 and 2, and along its length approximately near the first end 26 is the torso length frame adjustment 94 as shown in FIG. 2. The bottom section of the base frame 12 rests on the floor, as shown in FIG. 2 and the upper level is designed to accept two or more bench apparatuses 42, 44, as shown in FIGS. 1 and 2, more specifically the torso seat pad 42 and the hip seat pad 44. The first end 26 of the frame unit 24 has a variable shoulder width frame adjustment 30, 32 as shown in FIGS. 1 and 3, and the arm frame adjuster fittings 72, 74, as shown in FIGS. 1 and 2, to allow for variable arm lengths of the user. The second end of the base frame 28 has the longitudinal leg frame adjuster sections 80, and the vertical adjuster section 85, as shown in FIGS. 1 and 2, to allow for variable lengths of the user's legs.

The middle of the length of the frame unit 24 has the abdominal flexion spring device 96, as shown in FIG. 2, to allow for the top level of the base frame 22, supporting the hip seat pad 44 and the torso seat pad 42 to move up and down with the flexion of the user's abdominals muscles, as the hip pad 44 and the torso pad 42 pivot on the fulcrum cross piece 98 under the middle of the seat pads 44 and 42. The frame unit 24 is preferably made of a light aluminum or steel material being strong enough to allow durability, but light enough to allow easy transport and storage. The spring 98, as shown in FIG. 2 can be as simple as a spring or more like a conventional shock absorber type device as commonly found in the market place. The frame unit 24 could be designed to have less height for easier storage, or have less length adjustability on all adjustable parts for certain limited therapeutic reasons or specific sports related ranges of motion. The frame unit 24 could have more of a spring-based frame to allow for more motion and coordinated movements while exercising. The spring 98 could have more adjustability for more motion or less motion of the abdominal muscles. The upper body portion of the exercise machine 10, or the lower body portion, could have adjustability to lean upward to allow the user to be more in a seated position if they desire. The frame unit 24 can be formed from round or square tubing.

The bench apparatus is an elongate covered padded structure commonly found in the market place, preferably in two sections, the torso supporting section 42 and the hip supporting section 44. Attached to the first end of the torso section is the similarly padded headrest section 100. As shown in FIGS. 2 and 3, the bench apparatus is an elongate covered padded structure, commonly found in the exercise equipment market place, preferably in two sections, the torso supporting section 42, and the hip supporting section 44. Attached to the torso section 42, is the headrest 100. Preferably all seat sections 42, 44 are made of a wooden base with a foam interior padding and a leather or vinyl covering. The bench apparatus sections 42, 44 could have more contours to fit more snugly to the shape of the users body. The sections 42, 44 could also have more sections or as few as one long section from head to hips, which would disallow abdominal action to focus more on limb movement and associated muscles.

The arm apparatuses 34, 36 are an elongate structure having a first end, a middle section and a second end. The second end 72, 74 has the rotatable handle 76, 78 perpendicular to the adjustable length arm adjoining a middle section having the tension creating or releasing device 102, 104, and the second end adaptably fitted to the base frame first end adjustable vertical arm accepting section 30, 32. As shown in FIGS. 1, 2 and 3, the arm apparatus 34, 36 is an elongate structure having a first end, a middle section and a second end. The handle 76, 78, best seen in FIGS. 1 and 3, is rotatable and perpendicular to the second end arm adjuster 72, 74. The arm handle length adjuster 72, 74 is in direct communication with and rotates through the axis of the middle section resistance device 102, 104. The middle section of the arm apparatus 34, 36, is preferably the friction-creating device 102, 104 similar to a brake pad used in a car or bicycle forced into direct pressure against the rotating axel of the arm apparatus 34, 36. These friction-creating devices 102, 104 are commonly found in the market place used in vehicles as mentioned and also in exercise equipment. In the present invention the brake pad mechanism 102, 104 can be tightened to adjustably create more friction and resistance by turning a screw handle (not illustrated) inward or outward to the desired resistance level as is done in some common exercise equipment in use today.

The arm apparatus 34, 36 preferably fits into the arm frame adjusters 30, 32, as shown in FIG. 1, and the handles 76, 78 can then be rotated in an up and down arc or circular motion in either direction, as shown in FIGS. 1 and 2 by a circular arrow 116. As shown in FIG. 3, the arm apparatus 34, 36 can be vertically rotated and adjusted at the second end 72, 74, as shown in FIGS. 1 and 2, for the handles 76, 78 to be rotated on an in and out circular motion, as shown by arrows 118, 120 in FIG. 3. The arm apparatus 34, 36 allows for several different ranges and directions of motion, but additional variations such as spring biased adjustable lengths of the arm motions (not illustrated) would allow elliptical or oblong movements. The arm apparatuses 34, 36 could be allowed to swivel to allow any type of direction at the user's discretion during the exercise without having to stop and make adjustments. The arm apparatuses 34, 36 could be connected by a detachable arm 122 (shown as dotted line in FIG. 1) to allow for use of only one resistance device 102 or 104 for the upper body movements. The arm 122 also would lock the arm apparatus 30, 32 to work together as a single unit, where desired and could include a cover (not illustrated). The frame of the arm apparatus 30, 32 can be made of round or square tubing.

The leg apparatus 40 is an elongate structure having a first end, a middle section, and a second end with the two opposable rotating arm pedal parts 108, 110. The first end 50 adaptably and adjustably fits into the leg accepting section 80 of the base frame second end. The length of the first end of the leg apparatus is adjustable along its length to the middle section. The middle section of the leg apparatus 40 is adaptably and rotatingly adjoining the tension creating and releasing device 92. The second ends of the leg apparatus are the adjustable opposing arm type structures 112, 114, each rotating outwardly and circularly around the axis of the tension device, and having the pedal structure 108, 110 on each end perpendicular to the adjustable arm length extending from the tension device 92. As shown in FIGS. 1 2, and 3, the leg apparatus 40, is an elongate structure having a first end adaptably fitted to the base frame second end 28, a middle section, and a second end with the two opposable rotating adjustable arm 112, 114 and the pedal parts 108, 110. The first end 50 adjustably fits along its length, and supports a middle section, as shown in FIGS. 1 and 2. The middle section resistance device 92 is similar in structure to the above described arm resistance devices 102, 104. The leg pedal length adjusters 112, 114, along the second end length of the leg apparatus, have two parts opposing each other in similar fashion to a bicycle pedal, arm and pedal, apparatus, as best shown in FIGS. 1 and 3. The leg apparatus 40 could be used with two moving arm pedals without opposing each other. The base frame at the end 28 could be split to allow two leg apparatuses 40 (not illustrated), one for each leg, so that outward and inward motions could be used similar to the motions for the upper body, as shown in FIG. 3. The frame can be made of round or square tubing.

As shown in FIGS. 1 and 2 the frame unit 24 has parallel lengths with cross supports and vertical supports, most of which are connected by welded joints. Adjustable sleeve type fittings allow connections at joints such as 94, as shown in FIGS. 1 and 2, each of which are secured by a pin or bolt 95 which fit through the frame's radius, or by a screw in handle bolt (not illustrated) also through the frame. The bench apparatus 42, 44 preferably is bolted to the top frame 22, and is allowed to pivot on it's fulcrum center support 98, by using a bolt 124 with a sleeve 126 through the upper portion of the top frame 22 at the fulcrum center under each bench 42 and 44 as best shown in FIG. 2. The spring 96, as shown in FIG. 2 is bolted to the top frame 22 and the lower base frame 12. The upper base frame 22 between the two sections of the bench apparatus 42, 44, as shown in FIGS. 1 and 2, above the spring 98 is also connected with a bolt, and has an overlap of the enlarged connection hole 126 to allow for up and down motion of the abdominal flexion and spring motion. The headpiece 100 is attached by one or more springs 130, which could be covered (not illustrated) that allow a defined range of motion for the neck of the user.

The resistance devices for the leg motion 92 and for the arm motion 102, 104 are mounted by welding or bolts similar in design to a bicycle pedal axel device. Tension or resistance can be applied inside or outside against the rotating axel, as is found in many exercise bicycles and tread mills. The handles 76, 78 and the pedals 108, 110, as shown in all FIGS. 1, 2 and 3, are attached also with a bolt through a sleeve allowing rotation as exercise is performed, as is commonly found on a bicycle pedal. A pair of belts 132, 134 of the bench apparatus 10 are attached (not illustrated) under the torso seat 42 and the hip seat 44 and bolted tightly (not illustrated) to the top frame 22, and are adjustably connected (not illustrated) above or to the side of the user, preferably using a Velcro type of connection. The belts 132, 134 can make use of a buckle or snap together connection (not illustrated) securing the user to the bench apparatus. All frame parts of the frame unit 24 can alternatively be bolted together or secured with push through pins as previously described with respect to the adjustment arms 34, 36, as can be seen in FIG. 2. Magnetic resistance mechanisms can also be employed in the pivoting sections 92, 102 and 104 as is commonly used in stationary bicycle wind trainers.

The anti gravity range of motion four limb dry swim exercise machine 10, marketed under the trademark AGROM-4LDS, operates by having the user lie on their back, after adjusting the resistance devices 92, 102 and 104 as desired, the arm and leg positions to the desired length for range of motion, and fastening the belts 136, 134 tightly to the torso and the hips. The user then begins to rotate the arm handles 76, 78 around the axis 102, 104 in an up and down circular motion as can be seen in FIGS. 1 and 2, and the leg pedals around it's axis 92, shown by arrows 116, 134, 136 as can be seen in FIGS. 1, 2 and 3. The user can make circular motions in either direction to emphasize different muscles, for example the upper body motion can be up toward above the head, then following the circular motion out away from the chest and then down toward the abdominals followed by beginning to pull the handles 76, 78 back up toward the chest, which would emphasize different muscles than rotating the handles in an opposite direction. The arms can move in a half revolution ahead of each other in a fashion similar to peddling a bicycle or the user can rotate the handles 76, 78 together in the circular path in either direction. The arm apparatus 34, 36 can be rotated 90 degrees at its adjustable arm frame to emphasize different muscle groups, as shown by the arrows 118, 120 in FIG. 3. The range of motion can be easily changed to a smaller or larger range depending on the specific needs or goals of the user by adjusting the arm lengths at the sections 72, 74 and the leg lengths at the sections 112, 114. The resistance can be increased or decreased also at the arm tension devices 102, 104 and leg tension device 92. A typical workout could be to start slowly with a smaller range of motion with little or no resistance for a warm up. As the workout progresses, the range of motion and resistance could be increased to work harder through a fuller range of motion. The arms and legs and abdominals can all work in unison thereby creating more work and coordination of effort and body parts. The AGROM-4LDS exercise machine 10 is an extremely versatile system allowing emphasis on virtually any muscle group or anaerobic or aerobic needs or goals. The machine 10 can build or tone, build strength or endurance, is light, compact and portable and can be used by any age person or user for any type of goal.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the various parts of the present invention, to include variations in size, materials, shape, form, function and manner of operation, assembly and use, are deemed readily apparent to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claims of the present invention.

What is claimed is:

1. An exercise machine, comprising:

a bench having a length and width mounted on a frame for a user to lie on their back, said bench and frame being formed in two sections adjustable longitudinally;

a pair of adjustable arm exercise mechanisms mounted on a first end of said frame, each of said arm mechanisms including a rotatable arm to be rotated around an axis of rotation by the user's arms;

at least one adjustable leg exercise mechanism mounted on a second end of said frame, said leg mechanism including a pair of rotatable pedals to be rotated by the user's feet so that the user's feet and pedals move in a circular motion around an axis of rotation transverse to a direction along the bench's length, said leg mechanism longitudinally adjustable from said frame to accommodate the length of a user's legs; and a shock absorbing crosspiece mounted to the frame between said two sections and defining a fulcrum to allow said sections to be tilted relative to one another, and a shock absorber-like device mounted to the frame to provide spring support for the crosspiece at its fulcrum, the tilting of the sections by pivoting of the crosspiece as the shock absorber device moves allowing the user to bend abdominally.

2. The exercise machine of claim 1, including a headrest mounted to said bench at said first end of said frame.

3. The exercise machine of claim 2, including said headrest mounted to said frame by at least one spring mechanism to allow a range of motion for the user's head and neck.

4. The exercise machine of claim 1, including each said arm mechanism being laterally adjustable from said frame width to accommodate the width of the user's arms and shoulders.

5. The exercise machine of claim 4, including each said arm mechanism being vertically adjustable from said frame bench to accommodate the length of the user's arms.

6. The exercise machine of claim 1, including each said arm mechanism being vertically adjustable from said frame bench to accommodate the length of the user's arm.

7. The exercise machine of claim 1, including at least one of said arm mechanisms rotatable about an adjustable tension device.

8. The exercise machine of claim 1, including a bar attachable to said arm mechanisms to fix their relationship to cause such arm mechanisms to rotate together, and detachable to permit the arm mechanisms to rotate independently of one another.

9. The exercise machine of claim 8, including each of said arm mechanisms rotatable about an adjustable tension device mounted at said axis of rotation of said arm mechanism.

10. The exercise machine of claim 1, including said arm mechanism pivotable vertically to rotate said axis rotation.

11. The exercise machine of claim 1, including said leg mechanism vertically adjustable from said frame to adjust the circle of rotation of said pedals.

12. The exercise machine of claim 11, including said leg mechanism including said pedals being adjustable for said axis of rotation.

13. The exercise machine of claim 1, including said leg mechanism rotatable about an adjustable tension device.

14. The exercise machine of claim 13, including said adjustable tension device mounted at said axis of rotation.

15. An exercise machine, comprising:

a bench having a length and width mounted on a frame for a user to lie on their back, including a headrest mounted to said bench at a first end of said frame by at least one spring mechanism to allow a range of motion for the user's head and neck, said bench and frame being formed in two sections adjustable longitudinally;

a pair of adjustable arm exercise mechanisms mounted on said frame, each of said arm mechanisms including a rotatable arm to be rotated around an axis of rotation by the user's arms, each said arm mechanism being laterally adjustable from said frame width to accommodate the length of the user's arms and including at least one of said arm mechanisms rotatable about an adjustable tension device;

at least one adjustable leg exercise mechanism mounted on a second end of said frame, said leg mechanism including a pair of rotatable pedals to be rotated by the user's feet so that the user's feet and pedals move in a circular motion around an axis of rotation transverse to a direction along the bench's length, said leg mechanism longitudinally adjustable from said frame to accommodate the length of the user's legs and vertically adjustable from said frame to adjust the circle of rotation of said pedals and said leg mechanism rotatable about an adjustable tension device; and a shock absorbing crosspiece mounted to the frame between said two sections and defining a fulcrum to allow said sections to he tilted relative to one another, and a shock absorber-like device mounted to the frame to provide spring support for the crosspiece at its fulcrum, the tilting of the sections by pivoting of the crosspiece as the shock absorber device moves allowing the user to bend abdominally.

16. The exercise machine of claim 15, including a bar attachable to said arm mechanisms to fix their relationship to cause such arm mechanisms to rotate together, and detachable to permit the arm mechanisms to rotate independently of one another.

17. The exercise machine of claim 15, including each of said arm mechanisms rotatable about an adjustable tension device mounted at said axis of rotation of said arm mechanism.

18. The exercise machine of claim 15, including said arm mechanism pivotable vertically to rotate said axis of rotation.

19. The exercise machine of claim 15, wherein the spring mechanism extends at least part of the way across a space between the headrest and the frame.

* * * * *